United States Patent [19]

Pena, Jr.

[11] 4,139,077

[45] Feb. 13, 1979

[54] LADDER FURNITURE

[76] Inventor: Roberto E. Pena, Jr., 3003 W. Vermont, Blue Island, Ill. 60406

[21] Appl. No.: 783,813

[22] Filed: Apr. 1, 1977

[51] Int. Cl.[2] ..... E06C 1/00; A47D 11/00; A47B 85/00

[52] U.S. Cl. ..... 182/35; 182/129; 312/237; 312/278

[58] Field of Search ..... 182/35, 28, 129; D6/80, D6/160, 165; 312/237, 278

[56] References Cited

U.S. PATENT DOCUMENTS

| | | | |
|---|---|---|---|
| 129,704 | 7/1872 | Andrews | 312/278 |
| 927,671 | 7/1909 | Nicholson | 312/278 |
| 2,499,773 | 3/1950 | Owens | 182/38 |

*Primary Examiner*—Reinaldo P. Machado
*Attorney, Agent, or Firm*—John Vander Weit, Jr.

[57] ABSTRACT

An article of furniture providing a flight of steps employing a chest of drawers and a desk within the frame supporting the top step.

7 Claims, 3 Drawing Figures

LADDER FURNITURE

BACKGROUND OF THE INVENTION

1. Field of the Invention

This invention relates to articles of furniture and, in particular, to the provision therewith of a flight of steps.

2. Description of the Prior Art

The ingenuity of man has developed many combined function pieces of furniture including steps built or provided therewith. One interesting disclosure by Owens in U.S. Pat. No. 2,499,773 showed an inverted desk as a pair of steps. Horn in U.S. Pat. No. 2,495,374 discloses steps in the front of a commode which provides drawers in its side. Neither of these would be well suited to a greater number of steps as inversion would be physically difficult and the other would unnecessarily occupy too much space and require too much lumber.

OBJECTS

It is therefore an object of this invention to overcome the limitations and disadvantages in the furniture devices in the prior art and currently available in the market.

One of the objects of the invention is to provide a furniture device embodying improved principles of design and construction.

An important object of the invention is to provide a furniture device which is comprised of a number of simple durable components which can be economically manufactured and readily assembled.

A significant object of the invention is to provide a furniture device, so designed and constructed that it can be easily installed in almost any typical environment.

Another object of the invention is to provide a series of steps for secure access to elevated places.

A further object of the invention is to provide a chest of drawers in conjunction with the steps.

Yet another object of the invention is to provide a desk.

SUMMARY OF THE INVENTION

An article of furniture according to the principles of this invention, comprises a chest of drawers, horizontal step platforms, a frame with a desk durface and a drawer, the whole constituting a flight of steps.

Further objects and advantages of this invention will appear more clearly from the following description of a non-limiting illustrative embodiments and the accompanying drawings in which like numerals designate like parts throughout the several views.

BRIEF DESCRIPTION OF THE DRAWINGS

Briefly summarized, a preferred embodiment of the invention is described in conjunction with an illustrative disclosure thereof in the accompanying drawings, in which.

DESCRIPTION OF TYPICAL EMBODIMENT

Figure 1:
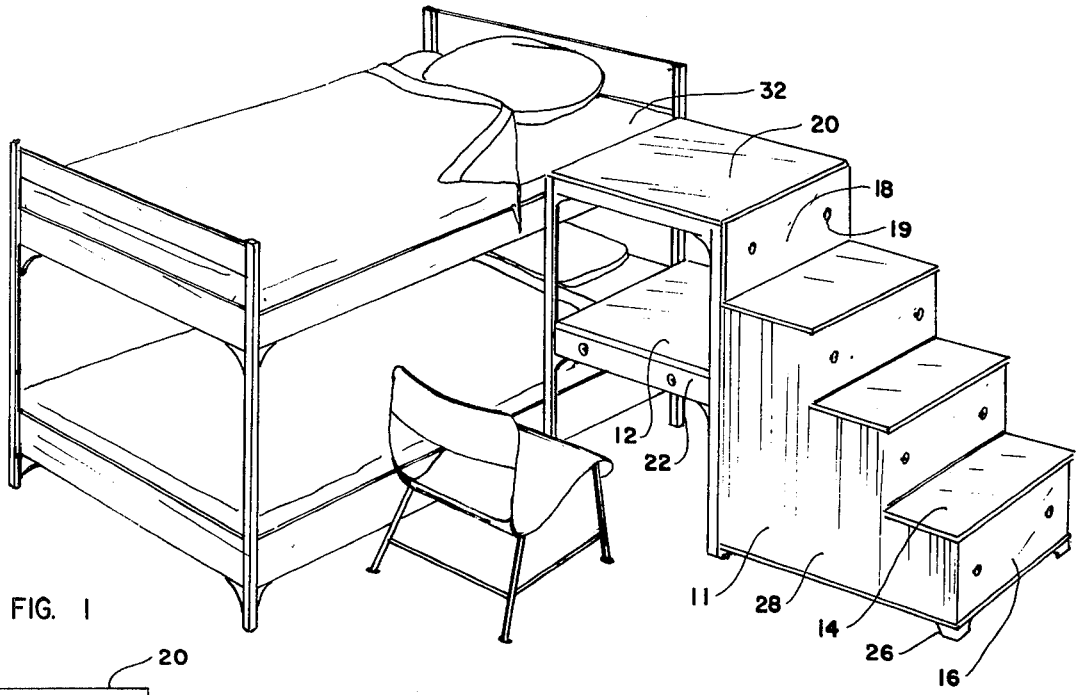
FIG. 1 is a pictorial representation of the ladder furniture adjacent a bunk bed.
Figure 2:
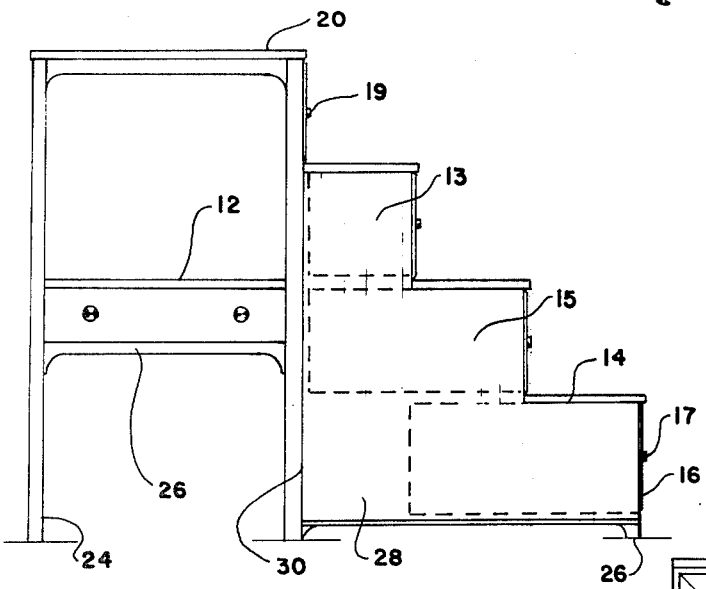
FIG. 2 is a side elevation of the ladder furniture illustrating the arrangement thereof according to the principles of this invention.
Figure 3:
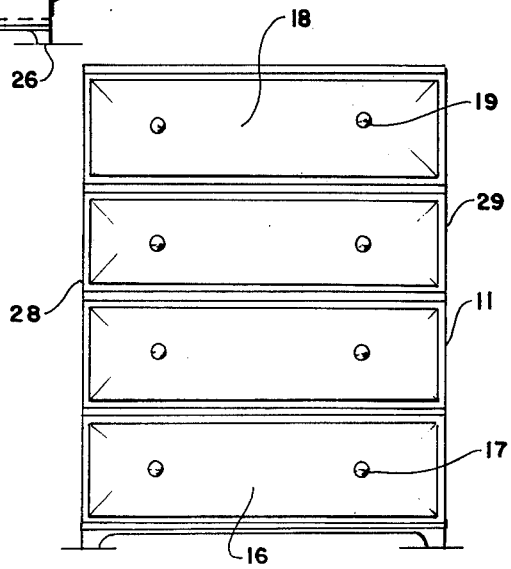
FIG. 3 is a front elevation of the ladder furniture.

In the drawings an article of furniture 11 embodying the features of the invention is illustrated providing a flight of steps 14 to 20 to provide secure access to an elevated place such as a bunk bed 32. The flight of steps is constructed by a chest of drawers 11 and a desk 12 unit 20 wherein the drawer front 16 is located at the rise of the particular step and the platform 14 above the drawer comprises the step tread. All the upper drawers, when pulled out, may rest upon the next lower platform, thereby providing a desirable support for extended drawers. The side panel 28 of the chest may be solid or decoratively pieced.

The uppermost rise 18 adjacent the desk frame 24 may be simulated to resemble a drawer with suitable matching pulls 19 the same as 17 and may be part of chest bark 30.

As seen, drawers 13, 15 may be of different lengths, even short as the bottom drawer is shown.

Top platform 20 is supported by frame 24 having two or four legs depending upon whether it can stand separately from the chest of drawers. Writing desk surface 12 is connected to and is aupported by the legs 24 and may cover a drawer 22 supported by 26.

The furniture may be made by known manufacturing methods of known materials including wood products, metals or plastics.

An important advantage of the invention is to provide a furniture device which is comprised of a number of simple durable components which can be economically manufactured and readily assembled.

A significant advantage of the invention is to provide a furniture device, so designed and constructed that it can be easily installed in almost any typical environment.

Another advantage of the invention is to provide a series of steps for secure access to elevated places.

A further advantage of the invention is to provide a chest of drawers in conjunction with the steps.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. An article of furniture comprising a chest of drawers so arranged as to provide a series of steps to provide support for a foot ascending or descending, wherein:

a. the drawers are substantially horizontal and movable and b. substantially horizontal platforms covering at least some of the drawers and serving as step treads and c. the front of said drawer corresponds to the rise of the particular step, and further comprising a frame having legs and a top platform supported thereby and adjacent the chest so as to provide the last top step.

2. An article of furniture as in claim 1, wherein the frame further comprise a desk provided with a substantially horizontal platform at a convenient height for writing.

3. An article of furniture as in claim 2, wherein the desk further comprises a drawer below the writing platform.

4. An article of furniture as in claim 1, wherein at least one of the rises comprises a simulated drawer front.

5. An article of furniture comprising a chest of drawers so arranged as to provide a series of steps to provide support for a foot ascending or descending, wherein:

a. the drawers are substantially horizontal and movable and b. substantially horizontal platforms covering at least some of the drawers and serving as step treads, and further comprising a frame having legs and a top platform supported thereby and adjacent the chest so as to provide the last top step.

6. An article of furniture as in claim 5, wherein the frame further comprises a desk provided with a substantially horizontal platform at a convenient height for writing.

7. An article of furniture as in claim 6, wherein the desk further comprises a drawer below the writing platform.

* * * * *